US009468350B2

(12) United States Patent
Tawara et al.

(10) Patent No.: US 9,468,350 B2
(45) Date of Patent: Oct. 18, 2016

(54) CLEANING TOOL

(71) Applicant: KAO CORPORATION, Chuo-ku (JP)

(72) Inventors: Hirotoshi Tawara, Kawasaki (JP); Yukio Noda, Sumida-ku (JP); Satoshi Nagai, Sumida-ku (JP)

(73) Assignee: KAO CORPORATION, Chuo-ku (JP)

( * ) Notice: Subject to any disclaimer, the term of this patent is extended or adjusted under 35 U.S.C. 154(b) by 222 days.

(21) Appl. No.: 14/361,609

(22) PCT Filed: Nov. 30, 2012

(86) PCT No.: PCT/JP2012/081160

§ 371 (c)(1),
(2) Date: May 29, 2014

(87) PCT Pub. No.: WO2013/081131

PCT Pub. Date: Jun. 6, 2013

(65) Prior Publication Data

US 2014/0325774 A1 Nov. 6, 2014

(30) Foreign Application Priority Data

Dec. 2, 2011 (JP) ..... 2011-264915

(51) Int. Cl.
*A47L 11/22* (2006.01)
*A47L 11/33* (2006.01)
(Continued)

(52) U.S. Cl.
CPC ..... *A47L 11/22* (2013.01); *A47L 11/32* (2013.01); *A47L 11/33* (2013.01); *A47L 11/4041* (2013.01)

(58) Field of Classification Search
CPC ..... A47L 11/22; A47L 11/32; A47L 11/33; A47L 11/4041
USPC ..... 15/3, 4, 25–27, 39.5, 41.1, 46, 48.1, 15/52.1, 98
See application file for complete search history.

(56) References Cited

U.S. PATENT DOCUMENTS 271,284 A 1/1883 Snook
455,658 A * 7/1891 Cloud ..... A47L 11/4069 15/98

(Continued)

FOREIGN PATENT DOCUMENTS

CN 101433446 A 5/2009
CN 201299534 Y 9/2009

(Continued)

OTHER PUBLICATIONS

International Search Report Issued Mar. 5, 2013 in PCT/JP12/081160 Filed Nov. 30, 2012.

(Continued)

*Primary Examiner* — Mark Spisich
(74) *Attorney, Agent, or Firm* — Oblon, McClelland, Maier & Neustadt, L.L.P.

(57) ABSTRACT

A cleaning tool 10 having at least one side opening 41 and a cleaning roll 50 at a cleaning head 30, wherein a dust guide surface 42 for leading dust from a surface to be cleaned to the side opening 41 is provided along a lower end of the side opening 41; the cleaning roll 50 is formed of an elastic roll having a surface covered with a thin film 53, and is rotatably arranged in a position to close the side opening 41 and to be in contact with the surface to be cleaned; and the cleaning roll 50 rotating according to movement of the cleaning head 30 takes the dust through the dust guide surface 42 into the side opening 41 while pushing the dust against the surface to be cleaned.

18 Claims, 11 Drawing Sheets

(51) Int. Cl.
*A47L 11/32* (2006.01)
*A47L 11/40* (2006.01)

(56) References Cited

U.S. PATENT DOCUMENTS

| | | | | |
|---|---|---|---|---|
| 1,487,052 | A * | 3/1924 | Enomoto | B43L 21/02 15/210.1 |
| 3,906,585 | A | 9/1975 | Mattsson | |
| 4,080,683 | A * | 3/1978 | Yi | A47L 11/33 15/121 |
| 4,642,831 | A * | 2/1987 | Roth | A46B 3/18 15/1.51 |
| 4,646,380 | A | 3/1987 | Kobayashi et al. | |
| 6,783,600 | B2 | 8/2004 | Tawara et al. | |
| 7,003,840 | B2 | 2/2006 | Tawara et al. | |
| 7,134,160 | B2 | 11/2006 | Tawara et al. | |
| 7,603,052 | B2 | 10/2009 | Honobe et al. | |
| 7,810,204 | B2 | 10/2010 | Godfroid et al. | |
| 2003/0204923 | A1 | 11/2003 | Nakamura | |
| 2006/0265824 | A1 | 11/2006 | Knopow | |
| 2007/0177891 | A1 | 8/2007 | Honobe et al. | |
| 2009/0126133 | A1 | 5/2009 | Ryu | |
| 2011/0265279 | A1 | 11/2011 | Kawaguchi et al. | |

FOREIGN PATENT DOCUMENTS

| | | | |
|---|---|---|---|
| CN | 102046060 | A | 5/2011 |
| GB | 1 392 150 | A | 4/1975 |
| JP | 54-175872 | U | 12/1979 |
| JP | 55 23481 | | 6/1980 |
| JP | 60 31724 | | 9/1985 |
| JP | 61-037127 | A | 2/1986 |
| JP | 61 75255 | | 5/1986 |
| JP | 62-64459 | U | 4/1987 |
| JP | 63 35246 | | 7/1988 |
| JP | 7 19414 | | 5/1995 |
| JP | 11-56731 | A | 3/1999 |
| JP | 11-206698 | A | 8/1999 |
| JP | 2003 164402 | | 6/2003 |
| JP | 2003-164402 | A | 6/2003 |
| JP | 2003-190886 | A | 7/2003 |
| JP | 2005 34452 | | 2/2005 |
| JP | 2005-034452 | A | 2/2005 |
| JP | 3641618 | | 4/2005 |
| JP | 3641618 | B | 4/2005 |
| JP | 2005 254015 | | 9/2005 |
| JP | 2005-254015 | A | 9/2005 |
| JP | 2005 254019 | | 9/2005 |
| JP | 2005-254019 | A | 9/2005 |
| JP | 2007-175473 | * | 7/2007 |
| JP | 2007-206340 | A | 8/2007 |
| JP | 2010-99565 | A | 5/2010 |
| JP | 2011-152389 | A | 8/2011 |
| WO | WO 2010/087970 | A1 | 8/2010 |

OTHER PUBLICATIONS

Extended European Search Report issued Jul. 27, 2015 in Patent Application No. 12853852.7.

English translation of the International Preliminary Report on Patentability and Written Opinion issued Jun. 12, 2014 in PCT/JP2012/081160.

* cited by examiner

CLEANING TOOL

TECHNICAL FIELD

The present invention relates to a cleaning tool.

RELATED ART

As described in Patent Literature 1, some cleaning tools have a side opening and a rotary brush at a cleaning head. Along a lower end of the side opening, a dust guide surface for leading dust from a surface to be cleaned to the side opening is provided. The rotary brush is coaxially fixed to a shaft of a drive wheel rolling on the surface to be cleaned, and is arranged in a position to be in contact with the surface to be cleaned and the dust guide surface on a front surface of the side opening. The rotary brush that rotates according to movement of the cleaning head scrapes up the dust on the surface to be cleaned, and collects the dust from the dust guide surface through the side opening into a dust container.

Further, Patent Literature 2 discloses a technique of a cleaning tool of a rotation roller type which has an elastic roller provided with restriction wheels of a relatively small diameter on its opposite side surfaces, and a dust guide plate disposed in the axial direction of a circularly curved surface of the elastic roller, in which dust on a surface to be cleaned is captured and fed to the dust guide plate while the elastic roller is pressed and rotated, and the dust is put into a dust container by pressing and sliding the dust on the dust guide plate without changing its state. In Patent Literature 2, a sponge roller is exemplified as the elastic roller.

CITATION LIST

Patent Literature

Patent Literature 1: JP 3641618 B1
Patent Literature 2: JP 55-23481 Y2

SUMMARY OF THE INVENTION

Problems to be Solved by the Invention

The cleaning tool described in Patent Literature 1 has the following problems.

(1) The rotary brush scrapes up particle dust (rice, confectionery chips, dirt, sand or the like), hair, or dust ball on the surface to be cleaned, but the hair and dust ball may be entwined around the rotary brush and may not be put into the dust container. When a large amount of hair and dust ball are entwined around the rotary brush, such hair and dust ball may adhere to the surface to be cleaned again to smear the surface to be cleaned.

(2) In the rotary brush, the side opening cannot be closed because gaps are present between bristles thereof. When the cleaning head is lifted up from the surface to be cleaned or is inverted, the particle dust or the like collected in the dust container comes out through the side opening to scatter around.

(3) The rotary brush is fixed coaxially to the shaft of the drive wheels at the opposite sides. Therefore, a cleaning range of the rotary brush with respect to the whole width of the cleaning head is narrow. Also, a range of the wheel width from near a wall becomes an uncleanable range.

The cleaning tool described in Patent Literature 2 has the following problems.

(1) When the sponge roller is used as the elastic roller, dust and smear on the surface to be cleaned enters apertures on a sponge surface at and after the start of use, and it is difficult to put the dust into the dust container. Also, a lifetime has been extremely short due to rapid smearing of the sponge roller and/or clogging thereof.

(2) When a non-foamed ordinary rubber roller is used as the elastic roller, capturing dust has been more difficult than the sponge roller in terms of softness required for the roller to capture dust. Also, a high friction occurs between the roller rubber and the surface to be cleaned, and therefore a force is required, for example, when the rubber roller is to be slid in the axial direction in order to capture dust near a wall. Therefore there has been a problem in operability of the cleaning tool.

An object of the present invention is to collect stably dust on a surface to be cleaned through a wide range of the surface to be cleaned.

Means for Solving the Problems

The present invention according to claim 1 provides a cleaning tool having at least one side opening and a cleaning roll (pushing roll) at a cleaning head. The cleaning tool is configured such that a dust guide surface for leading dust from a surface to be cleaned to the side opening is provided along a lower end of the side opening; the cleaning roll is formed of an elastic roller having a surface covered with a thin film, and is rotatably arranged in a position to close the side opening and to be in contact with the surface to be cleaned; and the cleaning roll rotating according to movement of the cleaning head takes the dust through the dust guide surface into the side opening while pushing the dust against the surface to be cleaned.

Preferably, the thin film has such a thickness that can conform to elastic deformation of the cleaning roller without impairing softness of the cleaning roll, and has a thickness preferably from 10 μm to 100 μm, and more preferably from 10 μm to 50 μm.

The thin film covering the surface of the cleaning roll increases a lifetime of the cleaning roll by preventing dust and smear from adhering to the roller surface, facilitates slide in the axial direction of the cleaning roll by reducing a coefficient of friction of the roll surface, and improves operability of the cleaning tool. Further, when the cleaning roll is formed of a particle-compacted roll or a fiber-compacted roll, the thin film also serves to retain the shape of the cleaning roll in a roll-like shape.

Effect of the Invention

According to the present invention, since the cleaning roll having the elastic roll covered with the thin film is used, the dust on the surface to be cleaned can be stably collected through a wide range of the surface to be cleaned.

DETAILED DESCRIPTION

Figure 1:
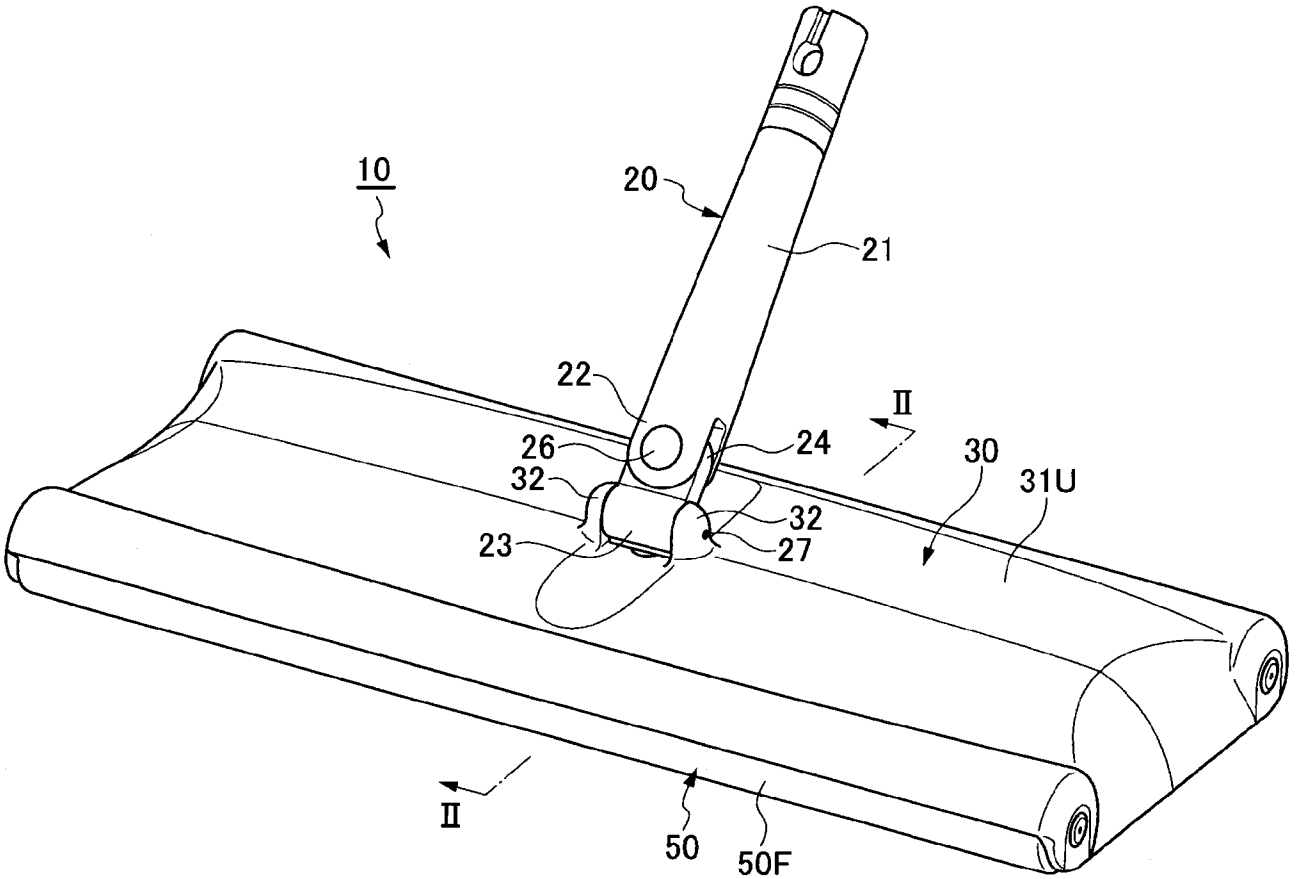
FIG. 1 is a perspective view of a cleaning tool.

A cleaning tool 10 illustrated in FIGS. 1 to 4 collects particle dust (rice, confectionery chips, dirt, sand and the like), hair and dust ball on a surface to be cleaned which is a wood floor, carpeted floor or the like. The cleaning tool 10 has a dust container 40 at a cleaning head 30 provided at a tip end of a handle 20, has front and rear side openings 41 (41F and 41R) provided at the front and rear of the dust container 40, and has front and rear cleaning rolls 50 (50F and 50R) closing these side openings 41.

Figure 3:
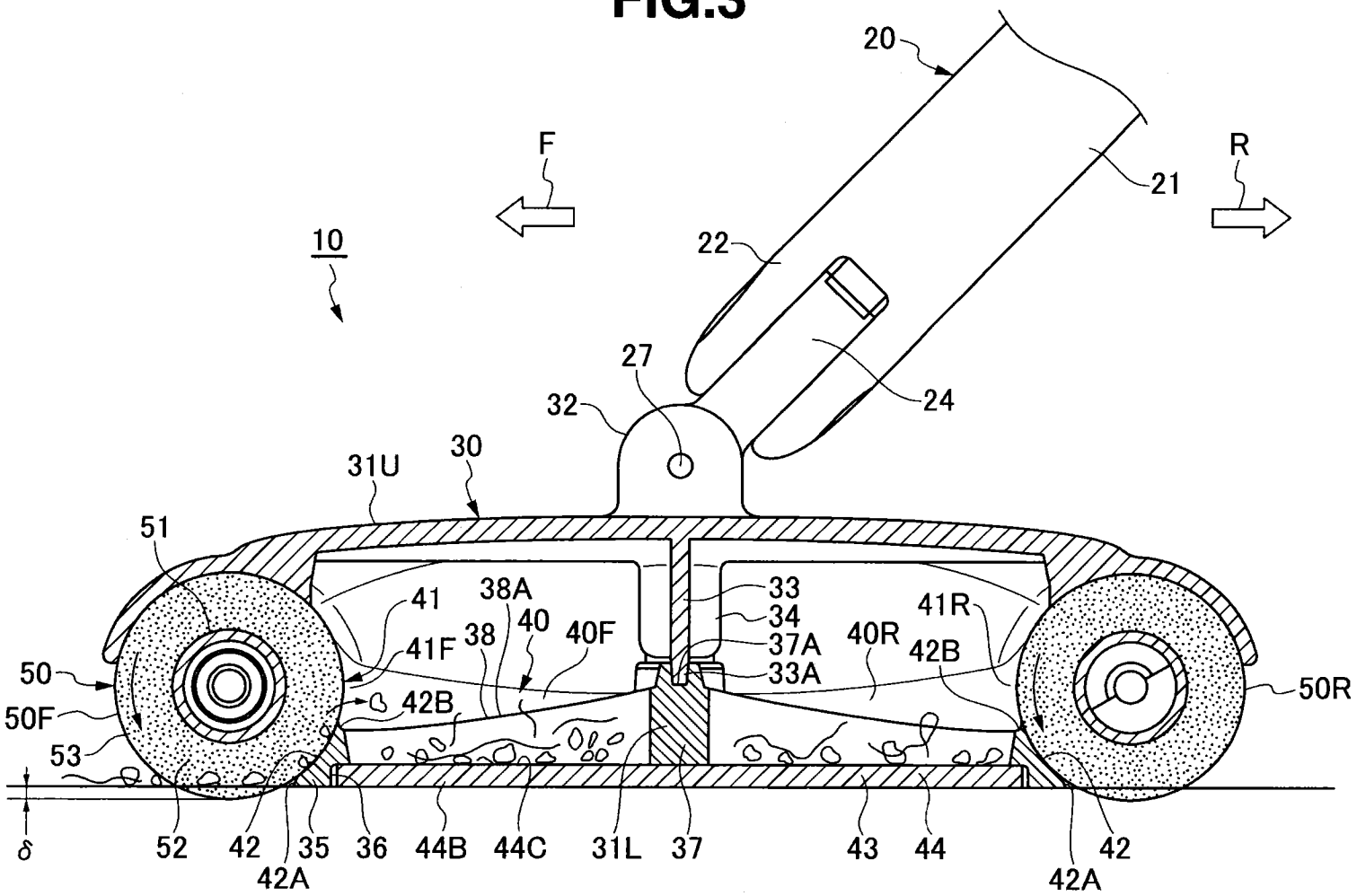
FIG. 3 is a cross sectional view taken along line II-II in FIG. 1.

It is to be noted that in the cleaning tool 10 of the present embodiment, an operation force applied to the handle 20 rolls the cleaning rolls 50 on the surface to be cleaned, a direction in which the cleaning head 30 travels by the pushing operation force applied to the handle 20 is referred to as a forward direction (a direction F in FIG. 3) and, a direction in which the cleaning head 30 travels by a pulling operation force applied to the handle 20 is referred to as a rearward direction (a direction R in FIG. 3).

Figure 2:
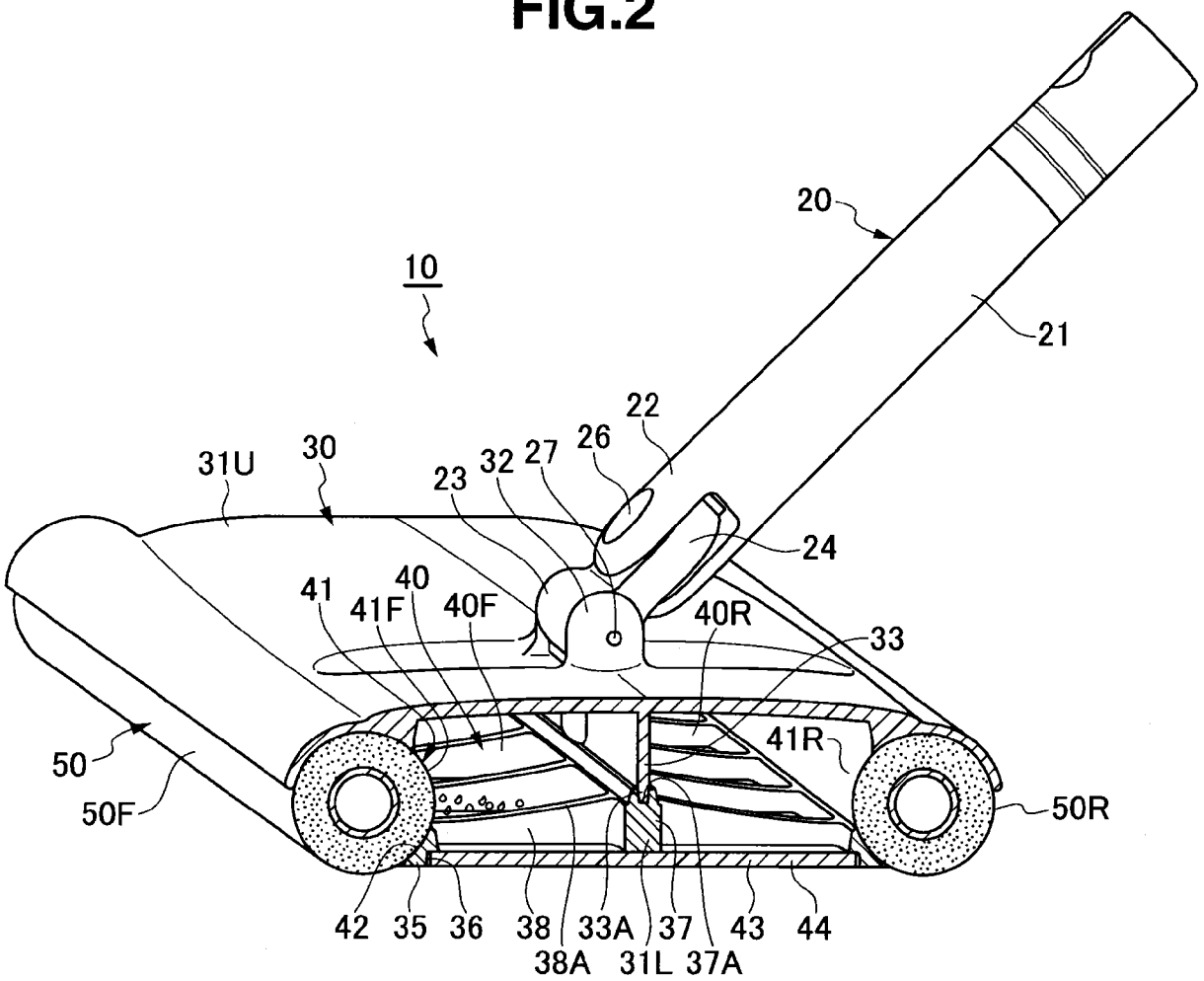
FIG. 2 is a perspective view taken along line II-II in FIG. 1.

As illustrated in FIGS. 1 to 3, the handle 20 is a long member of about 1 meter in length formed of a plurality of successively connected rods 21, and includes a grip at its base end. The handle 20 is provided at its tip end with a forked portion 22 having a slit into which a coupling plate 24 of a joint 23 is inserted, and the coupling plate 24 is pin-coupled to a bushing 26 fixed to the forked portion 22 by a screw 25 inserted into the forked portion 22. In addition, the joint 23 is inserted between left and right supports 32 and 32 which are provided at a central portion in the longitudinal direction (a traveling direction of the cleaning roll 50 due to the movement) and a lateral direction (the axial direction of the cleaning roll 50) of an upper frame 31U of the cleaning head 30, and is pin-coupled to a pin 27 fixed to these supports 32. The pin 27 extends in the lateral direction of the cleaning head 30, and the bushing 26 is arranged perpendicularly to the pin 27. This allows a user to swing laterally the handle 20 around the bushing 26, and to swing longitudinally the handle 20 around the pin 27.

In the handle 20, as illustrated in FIGS. 4(A) and (B), a central aperture of the rod 21 at its tip end is loaded with a coil spring 28, and a slider 28A elastically sprung by this coil spring 28 is pushed against an arc-shaped surface 24A (a surface in an arc centered at the bushing 26) provided at the coupling plate 24 of the joint 23 to restrict the free swinging of the handle 20 around the bushing 26. In addition, a central aperture provided and opened on an upper surface of a boss 34 (to be described later) of the upper frame 31U of the cleaning head 30 is loaded with a coil spring 29, and a slider 29A elastically sprung by this coil spring 29 is pushed against an arc-shaped surface 23A (a surface in an arc centered at the pin 27) provided at the joint 23 to restrict the free swinging of the handle 20 around the pin 27. Thereby, the user holding the handle 20 can lift up whole the cleaning tool 10 from the surface to be cleaned, and can move whole the cleaning tool 10 while keeping its initial position without changing a relative angular position of the cleaning head 30 with the handle 20.

Figure 4:
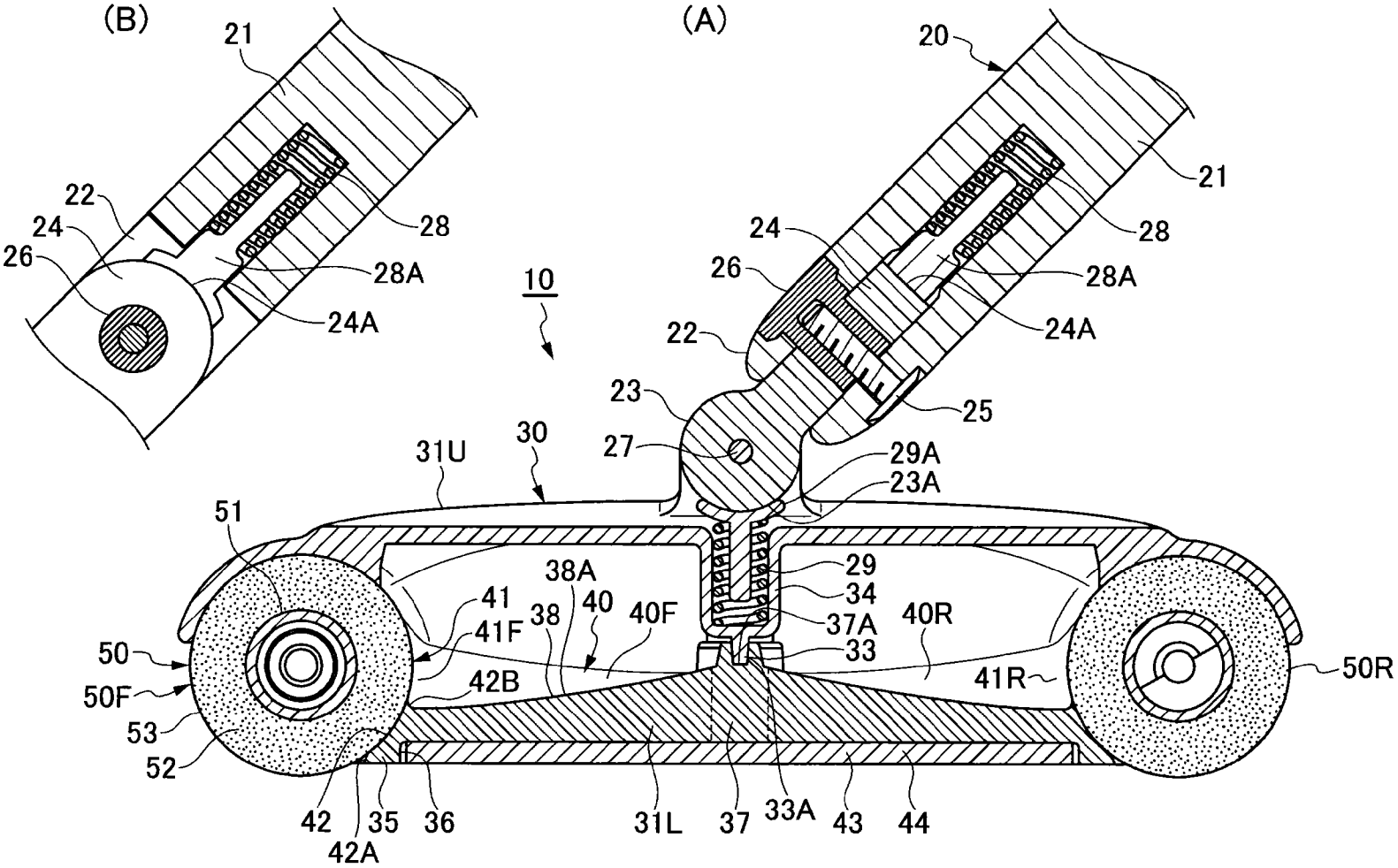
FIGS. 4(A) and (B) are cross sectional views including a joint portion of the cleaning tool.

As illustrated in FIGS. 2 to 4, the cleaning head 30 is formed of a combination of the upper and lower frames 31U and 31L coupled together.

The upper frame 31U extends throughout the longitudinal and lateral areas of the cleaning head 30, and arc-shaped covers provided at opposite ends in the longitudinal direction substantially cover the upper halves of the front and rear cleaning rolls 50. The upper frame 31U includes a central rib 33 which is suspended at a central portion in the longitudinal direction of the lower surface, and which extends throughout an area in the lateral direction crossing left and right side walls of the upper frame 31U. At a central portion in the lateral direction of the central rib 33 on the lower surface of the upper frame 31U, the boss 34 which is loaded with the foregoing coil spring 29 is projected downwardly.

Figure 7:
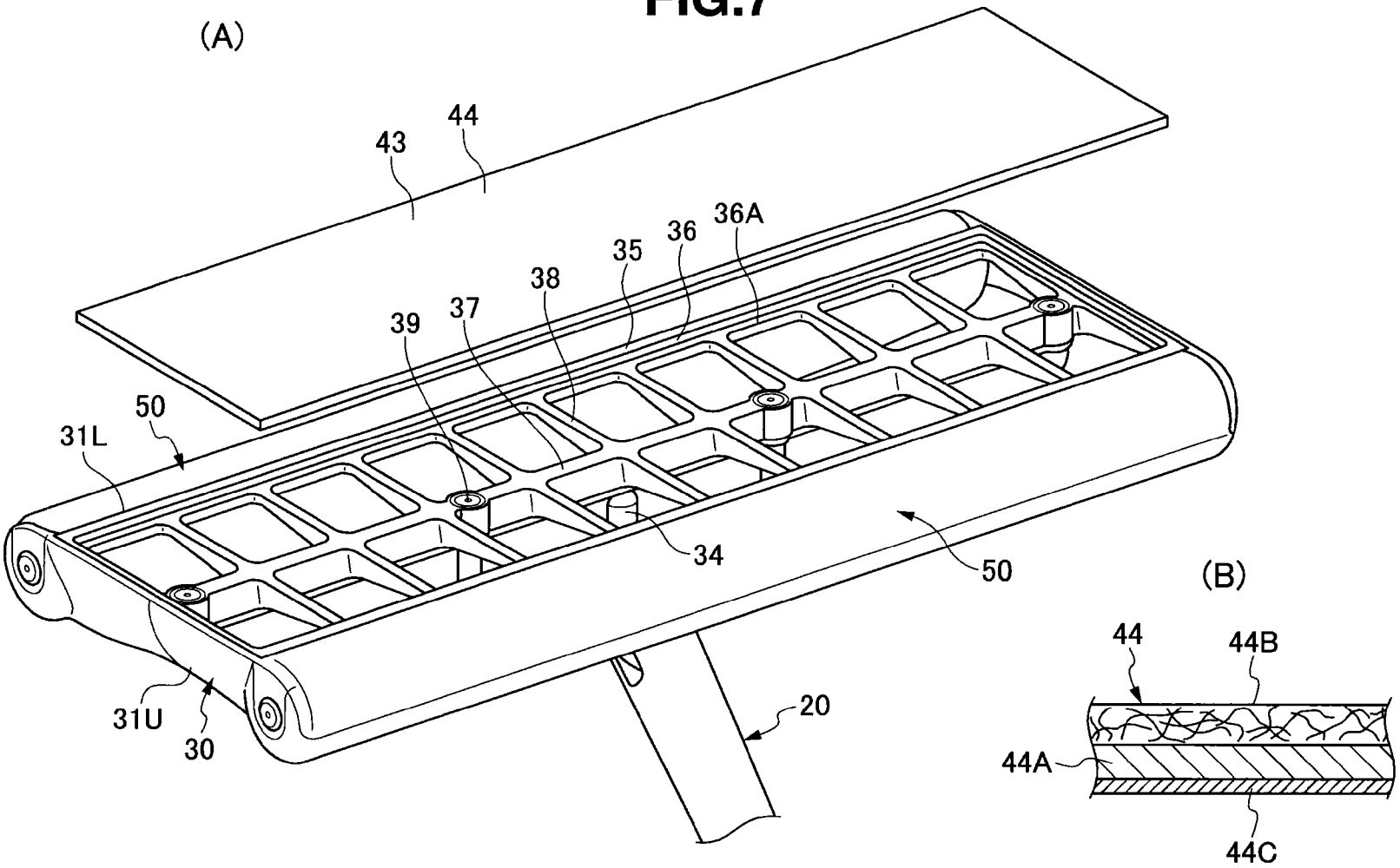
FIGS. 7(A) and (B) are perspective views illustrating the cleaning head from a lower surface side.

The lower frame 31L has a frame-like form fitted between the left and right side walls of the upper frame 31U, and has, as illustrated in FIGS. 7(A) and (B), a rectangular stepped portion 36 in which a lower surface of a rectangular outer peripheral frame 35 is a horizontal surface that can come into sliding contact with the surface to be cleaned and a bottom plate 43 (a cleaning sheet 44 to be described later) can be fitted into the inside of the lower surface of the outer peripheral frame 35. The stepped portion 36 forms a rectangular opening for removably attaching the bottom plate 43, and includes a stepped surface 36A having a stepped depth equal to a thickness of the bottom plate 43. The lower surface of the bottom plate 43 fitted into the stepped portion 36 of the lower frame 31L can be flush with the lower surface of the outer peripheral frame 35, and can come into sliding contact with the surface to be cleaned.

The lower frame 31L includes a central rib 37 within a surface of the stepped surface 36A included in the stepped portion 36 within the outer peripheral frame 35. The central rib 37 is included standing at a central portion in the longitudinal direction within the outer peripheral frame 35, and extending throughout the area in the lateral direction crossing the left and right stepped portions 36 of the outer peripheral frame 35. A lower surface of the central rib 37 is flush with the stepped surface 36A of the stepped portion 36.

Figure 5:
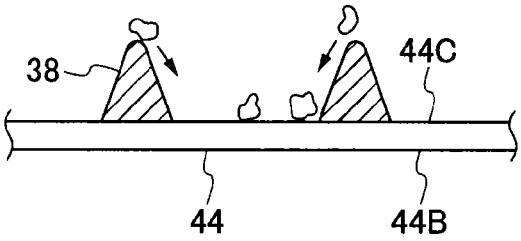
FIG. 5 is a cross sectional view crossing a cross member of a lower frame of a cleaning head.

The lower frame 31L includes a plurality of cross members 38 which are parallel to each other between the stepped portions 36 at the front end side and rear end side of the outer peripheral frame 35 and the central rib 37. A lower surface of each cross member 38 is flush with the stepped surface 36A of the stepped portion 36 and the lower surface of the central rib 37. An upper surface of each cross member 38 forms a curved and inclined surface 38A which descending from the upper portion of the central rib 37 to the upper portion of the outer peripheral frame 35. It is to be noted that as illustrated in FIG. 5, the cross member 38 has a triangular cross section having a narrower upper surface to facilitate falling of the dust put in by the cleaning roll 50 as will be described later.

The lower frame 31L is coupled to the upper frame 31U by screwing screws 39 inserted through a plurality of locations on the lower surface of the central rib 37 into lower attaching portions of the upper frame 31U while keeping such a state that an upper end concavity 37A of the central rib 37 is fitted to a lower end convexity 33A of the central rib 33 of the upper frame 31U.

Thereby, the cleaning head 30 forms the dust container 40 between the upper and lower frames 31U and 31L in such a state that the upper and lower frames 31U and 31L are coupled together and the bottom plate 43 is fitted into the stepped portion 36 of the lower surface of the lower frame 31L. At a central portion in the longitudinal direction of the cleaning head 30, the dust container 40 is longitudinally partitioned by the central rib 33 of the upper frame 31U and the central rib 37 of the lower frame 31L. The cleaning head 30 has front and rear dust containers 40F and 40R. The front dust container 40F includes a side opening 41F opened forward, and the rear dust container 40R includes a side opening 41R opened rearward.

In the cleaning tool 10, dust guide surfaces 42 for leading the dust from the surface to be cleaned to the side openings 41 are provided along lower ends of the side openings 41 (41F and 41R) included in the dust containers 40 (40F and 40R) of the cleaning head 30. Outer side surfaces of the outer peripheral frame 35 at the front and rear sides of the lower frame 31L of the cleaning tool 30 form the dust guide surfaces 42 in the form of arc-shaped surface, each of which is in sliding contact with the outer periphery of the cleaning roll 50 throughout the length of the cleaning roll 50, or which is spaced from the outer periphery of the cleaning roll 50 by a minute gap. When the cleaning tool 10 moves, a lower end edge 42A of the dust guide surface 42 crossing the lower surface of the outer peripheral frame 35 at an acute angle comes into close contact and sliding contact with the surface to be cleaned, and scoops up the dust from the surface to be cleaned onto the dust guide surface 42. An upper end edge 42B of the dust guide surface 42 also forms an acute angle, and around the cleaning roll 50 rotating toward the upper end edge 42B (for example, when the cleaning tool 10 moves forward (the direction F in FIG. 3), the cleaning roll 50R in FIG. 3 located at the rear (the direction R in FIG. 3) of the cleaning tool 10), it is made difficult for the dust in the dust container 40 (40R) to enter the pushing roll 50 (50R) through the upper end edge 42B (FIG. 3).

At this time, the bottoms of the dust containers 40 (40F and 40R) are sealed by the bottom plate 43 fitted into the stepped portion 36 of the outer peripheral frame 35 of the lower frame 31L. As illustrated in FIGS. 7(A) and (B), the bottom plate 43 can be formed of the cleaning sheet 44. The cleaning sheet 44 includes a sheet-like wiper 44B made of nonwoven fabric or the like and bonded to a lower surface of a shape retaining layer 44A made of paperboard or the like, and includes a sheet-like adhesive 44C prepared by applying an adhesive to an upper surface of the shape retaining layer 44A. Coating for facilitating peeling such as Teflon (registered trademark) coating and the like is applied to the stepped surface 36A and the lower surfaces of the central rib 37 and the cross members 38 which are flush with each other within the stepped portion 36 of the outer peripheral frame 35. The sheet-like adhesive 44C of the cleaning sheet 44 is stuck on these surfaces in an easily peelable manner. Thereby, the cleaning sheet 44 is removably provided at the stepped portion 36 of the outer peripheral frame 35 such that the lower surface of the sheet-like wiper 44B is flush with the lower surface of the outer peripheral frame 35 of the lower frame 31L to be in contact with the surface to be cleaned of the cleaning head 30. During the cleaning with the cleaning tool 10, the sheet-like wiper 44B removes the fine dust such as dirt on the surface to be cleaned that slipped through the lower end edge 42A of the dust guide surface 42. In addition, the sheet-like adhesive 44C holds the dust that the cleaning roll 50 sandwiched with the dust guide surface 42 and put into the dust container 40 through the side opening 41.

Figure 6:
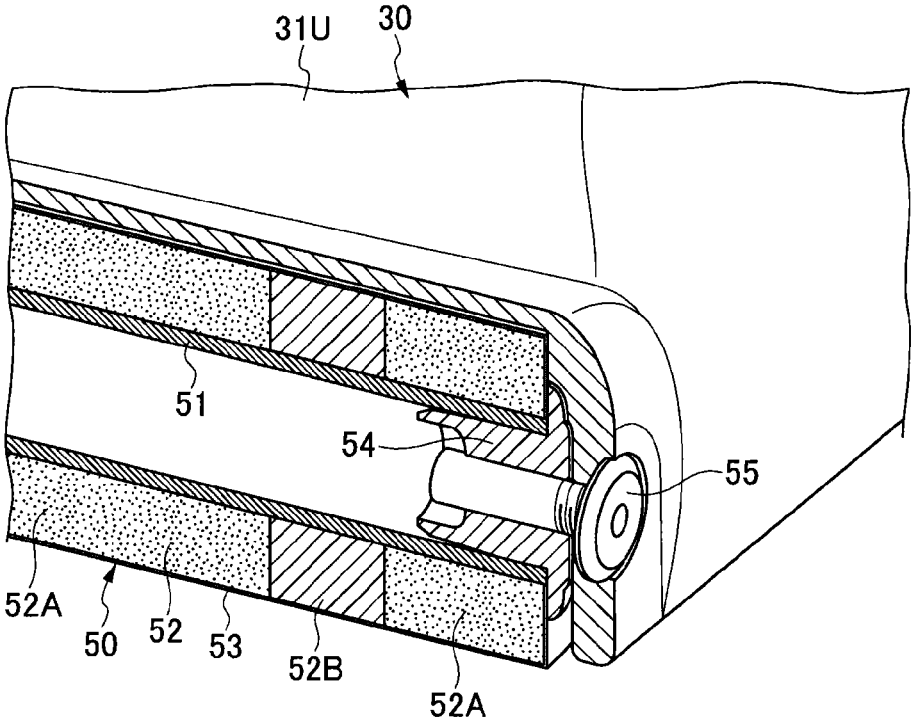
FIG. 6 is a perspective view illustrating a section of a support portion of the cleaning roll of the cleaning head.
Figure 9:
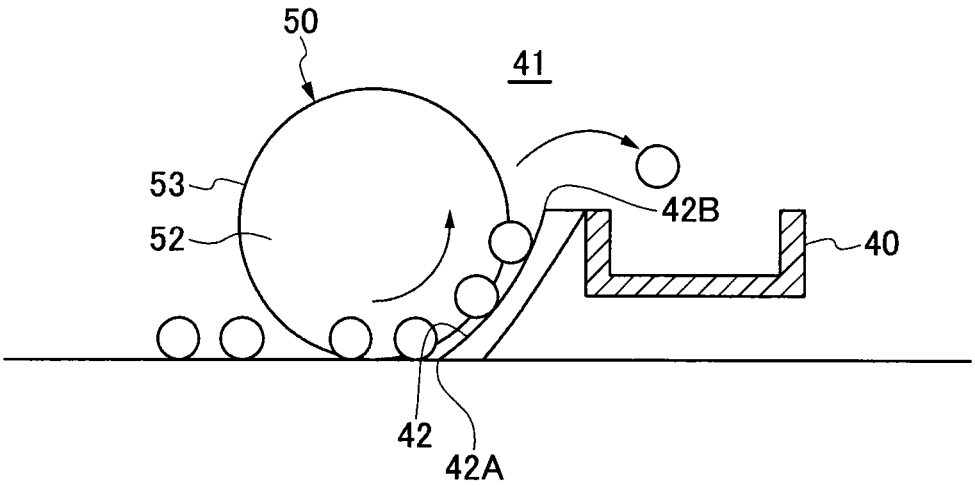
FIG. 9 is a schematic view illustrating a dust container, a dust guide surface and the cleaning roll.

The cleaning tool 10 pivot-supports, at the front and rear sides of the right and left side walls of the cleaning head 30 (the upper frame 31U), the opposite ends of the front and rear cleaning rolls 50 (50F and 50R), respectively. In the present embodiment, as illustrated in FIG. 6, the cleaning roll 50 is an elastic roll formed by depositing a sponge roll 52 on the outer periphery of a shaft tube 51 made of rigid plastics, or metal such as an aluminum pipe and the like throughout its circumference and length, and covering the surface of the sponge roll 52 throughout its length with a cylindrical thin film 53 which is, for example, resistant to electrification. The cleaning roll 50 closes the side opening 41 of the dust container 40, and is rotatably arranged in a position to be in contact with the surface to be cleaned. In addition, the cleaning roll 50 is rotatably arranged in a position preferably to be in contact with the dust guide surface 42. It is to be noted that as illustrated in FIG. 9, as long as it is possible to lead the particle dust and the like on the surface to be cleaned biting into the cleaning roll 50 to the dust guide surface 42 by the rotation of the cleaning roll 50, further pinch the dust between the cleaning roll 50 and the dust guide surface 42 to slide the dust upward onto the dust guide surface 42, and then put the dust into the dust container 40 through the side opening 41 by the elastic repulsive force of the sponge roll 52, the cleaning roll 50 may be rotatably arranged being spaced from the dust guide surface 42 by a constant and minute gap. An amount of the minute gap can be appropriately set depending on sizes of the collected dust. Further, the cleaning roll 50 has caps 54 which are inserted into the openings at the opposite ends of the shaft tube 51 and are fixed thereto. Support shafts 55 screwed and fixed to the left and right side walls of the upper frame 31U of the cleaning head 30 pass through central apertures of the caps 54, so that the cleaning roll 50 is pivot-supported by the cleaning head 30.

Figure 8:
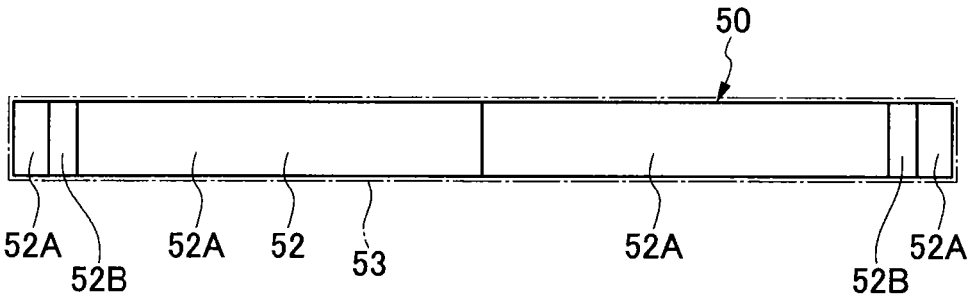
FIG. 8 is a schematic view illustrating the cleaning roll.

As illustrated in FIG. 8, the cleaning roll 50 is formed by putting the thin film 53 made of, e.g. heat-shrinkable film over the sponge roll 52, and thermally shrinking the thin film 53 to bring the thin film 53 into close contact with the surface of the sponge roll 52 to cover the sponge roll 52 with the thin film 53. For preventing adhesion of dust, an end surface of the sponge roll 52 is preferably covered with the end of the thin film 53 or is covered with a side film of the same material as the thin film 53. The sponge roll 52 is preferably made of urethane foam. The thin film 53 is preferably made of thermoplastic polyurethane resin. A hardness of the sponge roll 52 is measured by a measuring method of JIS K6400-2: 2004 (D method), and is preferably from 10 N to 100 N, more preferably from 15 N to 70 N, further preferably from 15 N to 60 N, even further preferably from 15 N to 50 N, and further more preferably from 15 N to 40 N. When the hardness falls within these ranges, the cleaning roll 50 does not run up onto the particle dust on the surface to be cleaned, and can be deformed in accordance with the shape of the particle dust so that the cleaning roll 50 can also take in other dust near the particle dust. When the cleaning roll 50 runs up onto the particle dust on the surface to be cleaned, a gap occurs between the cleaning roll 50 and the surface to be cleaned, and the cleaning roll 50 cannot take in the other dust near the particle dust without difficulty in some cases. It is to be noted that the present embodiment uses the sponge roll of 30 N in hardness. In addition, the foregoing hardness may be applied to a roll member (to be described later) other than the sponge roll. Meanwhile, the thin film 53 has a film thickness preferably of 10 μm to 100 μm, more preferably of 10 μm to 50 μm, further preferably of 10 μm to 40 μm, and further more preferably of 20 μm to 40 μm. When the film thickness of the thin film 53 falls within the above range, it can be deformed in accordance with the shape of the dust, and can be deformed integrally with the sponge roll 52. Further, the cleaning roll 50 does not run up onto the particle dust on the surface to be cleaned, and can be deformed in accordance with the form of the particle dust so that the cleaning roll 50 can take in the other dust near the particle dust. It is to be noted that the present embodiment uses the thin film of 30 μm in film thickness. In addition, the above film thickness of the thin film may be applied to a thin film material (to be described later) other than the thermoplastic polyurethane resin.

The thin film 53 covering the surface of the cleaning roll 50 can prevent dust and smear from adhering to the roll surface, and thereby can increase the lifetime of the cleaning roll 50. In addition, certain kinds of thin films can reduce a coefficient of friction of the roll surface to facilitate slide in the axial direction of the cleaning roll 50, and thereby can improve operability of the cleaning tool 10. In addition, when the cleaning roll 50 is formed of a particle-compacted roll or a fiber-compacted roll (to be described later), the thin film 53 serves to retain the shape of the cleaning roll 50 in a roll-like shape.

It is to be noted that in addition to using the above heat-shrinkable film, the method of covering the surface of the sponge roll with the thin film includes a method in which a film forming the thin film is wound over the surface of the sponge roll and opposite ends thereof are bonded (bonding with an adhesive, heat bonding or the like), a method of performing outsert of a film forming the thin film when molding the sponge roll, a method of applying a liquid agent which changes into a film to the surface of the sponge roll, a method of molding a material resistant to electrification into the sponge roll and forming a skin layer on the roll surface at the time of molding, and the like.

As illustrated in FIGS. 6 and 8, the cleaning roll 50 may form the sponge roll 52 by a plurality of roll members 52A and 52B of different hardness. When the roll members 52B (e.g., of a hardness of 50 N) harder than the main roll member 52A (e.g., of a hardness of 30 N) are provided in two positions at opposite end sides of the sponge roll 52, a pressing pressure of the sponge roll 52 against the surface to be cleaned increases to improve a grip force and then a frictional rotating force of the cleaning roll 50 with respect to the surface to be cleaned. When a sufficient grip force can be secured only by the roll member 52A, the roll member 52B is not required.

It is to be noted that in the case where the cleaning roll 50 is formed of the plurality of roll members 52A and 52B of different hardness, the thin film 53 may not be required provided that materials to be described later are appropriately selected. For example, the thin film 53 may not be required in the case where the roll member 52A is made of a non-porous material of a low coefficient of friction and the roll member 52B is made of a non-porous material of a high coefficient of friction.

The cleaning tool 10 is preferably configured such that, in the free state where the cleaning tool 10 is placed on the surface to be cleaned, the cleaning head 30 squashes under its own weight including the handle 20 the sponge roll 52 of the cleaning roll 50 on the surface to be cleaned to cause the lower surface of the cleaning head 30 (the lower surface of the outer peripheral frame 35 of the lower frame 31L) to abut on the surface to be cleaned. This is set according to a relationship between its own weight of the cleaning head 30 including the handle 20 and a repulsive force of the sponge roll 52. At this time, the lower surface of the cleaning head 30 (the lower surface of the outer peripheral frame 35 of the lower frame 31L) and the lower end edge 42A of the dust guide surface 42 determined by the lower surface of the outer peripheral frame 35 are set on the same horizontal surface. It is to be noted that Teflon (registered trademark) processing or the like is preferably applied to the lower surface of the cleaning head 30 (the lower surface of the outer peripheral frame 35 of the lower frame 310 for facilitating slide on the surface to be cleaned.

Accordingly, the cleaning tool 10 performs the cleaning operation as described below. It is to be noted that when the user moves the cleaning head 30 forward (the direction F in FIG. 3) with the handle 20, the front cleaning roll 50F performs the cleaning operation while being in close contact with the surface to be cleaned and rolling. When the cleaning head 30 is moved rearward (the direction R in FIG. 3), the rear cleaning roll 50R performs the cleaning operation while being in close contact with the surface to be cleaned and rolling. Since the cleaning roll 50, the dust guide surface 42, and the cleaning sheet 44 (the wiper 44B) are present throughout the widths of the upper and lower frames 31U and 31L of the cleaning head 30 as much as possible, even an area of the surface to be cleaned near a wall can be cleaned up.

(a) As illustrated in FIG. 9, the cleaning roll 50 deforms the thin film 53 and the sponge roll 52 so as to cause the particle dust and the like on the surface to be cleaned to bite thereinto, rolls on the surface to be cleaned while keeping on pushing the biting particle dust and the like against the surface to be cleaned, and thereby carries the particle dust and the like toward the dust guide surface 42 side. The particle dust and the like biting into the cleaning roll 50 are led to the dust guide surface 42, are further pinched between the cleaning roll 50 and the dust guide surface 42 to be slid upward onto the dust guide surface 42, and then put into the dust container 40 through the side opening 41 by the elastic repulsive force of the sponge roll 52. It is to be note that for the sake of convenience for illustration, FIG. 9 illustrates such that a constant minute gap is provided between the cleaning roll 50 and the dust guide surface 42, but the cleaning roll 50 may be brought into contact with the dust guide surface 42.

(b) The cleaning roll 50 leads the hair, dust ball and the like scooped by the lower end edge 42A of the dust guide surface 42 to the dust guide surface 42, and further pinches them with the dust guide surface 42 to slide them upward onto the dust guide surface 42, and then puts them into the dust container 40 through the side opening 41 by the elastic repulsive force of the sponge roll 52.

(c) Since the surface of the sponge roll 52 is covered with the thin film 53 resistant to electrification, the cleaning roll 50 can take the particle dust such as dirt into the apertures in the sponge to suppress smearing of the roll surface, and the frequency of the exchanging can be reduced. Further, the cleaning roll 50 captures the hair and dust ball without electrostatic adhesion thereof, and can put them through the side opening 41 into the dust container 40.

(d) The cleaning roll 50 closes the side opening 41 of the dust container 40. When the cleaning tool 10 is lifted up from the surface to be cleaned or inverted, the particle dust and the like collected in the dust container 40 do not come out through the side opening 41 to scatter around.

(e) When the cleaning roll 50 rotates rolling by itself on the surface to be cleaned, and is not accompanied with drive wheels at the opposite end sides. Therefore, the cleaning range of the cleaning roll 50 is large with respect to the whole width of the cleaning tool 10. Further, the cleaning roll 50 can access an area near the wall, and hardly leaves an uncleanable range near the wall.

(f) The sheet-like wiper 44B is provided on the lower surface of the cleaning head 30 to be in contact with the surface to be cleaned. Even when the fine dust such as dirt on the surface to be cleaned slips through a gap between the lower end edge 42A of the dust guide surface 42 and the surface to be cleaned, the wiper 44B on the lower surface of the cleaning head 30 wipes the fine dust.

(g) The cleaning head 30 has the dust container 40 including the side opening 41, and the sheet-like adhesive 44C is provided on the bottom surface of the dust container 40. The adhesive 44C holds the particle dust, hair, dust ball and the like already taken in onto the bottom surface of the dust container 40. The adhesive 44C holds the dust and the like against an inertial force caused by the movement of the cleaning tool 10. For example, the dust and the like are prevented from being pulled out through the rear side opening 41R by the rotation of the rear cleaning roll 50R provided in the direction opposite to the traveling direction of the cleaning tool 10.

(h) The cleaning sheet 44 is removably provided on the lower surface of the cleaning head 30 to be in contact with the surface to be cleaned, and the sheet-like wiper 44B is included on one surface of the cleaning sheet 44, and the sheet-like adhesive 44C is included on the other surface. By sticking the one cleaning sheet 44 on the lower surface of the cleaning head 30, the wiper 44B and the adhesive 44C described above can be provided. By peeling off the cleaning sheet 44 from the lower surface of the cleaning head 30, the dust collected in the dust container 40 can be disposed of while being held on the adhesive 44C of the cleaning sheet 44.

(i) When the sponge roll 52 is made of the urethane foam, and the thin film 53 is made of the thermoplastic polyurethane resin, the thin film 53 made of the thermoplastic polyurethane resin has an excellent anti-penetration property, a high electrical conductivity with a high resistance to electrification, and an elastic stretchability, and can conform well to deformation of the sponge roll 52 caused by the biting of particle dust.

(j) When the roll member 52A of the sponge roll 52 is excessively soft, there is a good capturing property due to the biting of dust particle into the roll member 52A, but a repulsive force against the surface to be cleaned such as a wood floor is small so that a frictional rotating force required for the rotation of the cleaning roll 50 cannot be obtained in some cases. Accordingly, the hard roll members 52B are provided, e.g., in two locations at the opposite end sides of the sponge roll 52. Thereby, the roll members 52B produce a large repulsive force against the surface to be cleaned, and the cleaning roll 50 can roll stably on the surface to be cleaned.

(k) The cleaning head 30 squashes under its own weight the sponge roll 52 on the surface to be cleaned to cause the lower surface of the cleaning head 30 to abut on the surface to be cleaned.

When the user holding the handle 20 of the cleaning tool 10 moves rearward to move the cleaning head 30 rearward, the operation force of the user tends to pull up the cleaning head 30 from the surface to be cleaned. Even in this case, the cleaning head 30 squashes under its own weight the sponge roll 52 to cause the lower surface of the cleaning head 30 to abut on the surface to be cleaned without floating it. Thereby, the stable cleaning can be performed even when the cleaning head 30 moves rearward.

When the user holding the handle 20 of the cleaning tool 10 swings (i.e., reciprocates circularly and laterally) the cleaning head 30 around the user, without the operation force of the user of pressing the cleaning head 30 against the surface to be cleaned, the cleaning head 30 squashes under its own weight the sponge roll 52 to cause the lower surface of the cleaning head 30 to abut on the surface to be cleaned without floating it. Thereby, the cleaning can be performed stably even when the cleaning head 30 is swung.

Regardless of the weak or strong operation force of the user of pressing the cleaning head 30 against the surface to be cleaned, the sponge roll 52 rolls on the surface to be cleaned and stably captures the dust on the surface to be cleaned while being in the state in which a constant squash amount δ (FIG. 3) (e.g., 1 mm) is imparted.

(l) In the above (k), the lower surface of the cleaning head 30 and the lower end edge 42A of the dust guide surface 42 are set on the same horizontal surface. Therefore, when the cleaning head 30 moves with its lower surface being in sliding contact with the surface to be cleaned, the lower end edge 42A of the dust guide surface 42 always slides on the surface to be cleaned to lead stably the particle dust and the like biting into the cleaning roll 50 to the dust guide surface 42, or to lead stably the hair, dust ball and the like on the surface to be cleaned to the dust guide surface 42.

Figure 10:
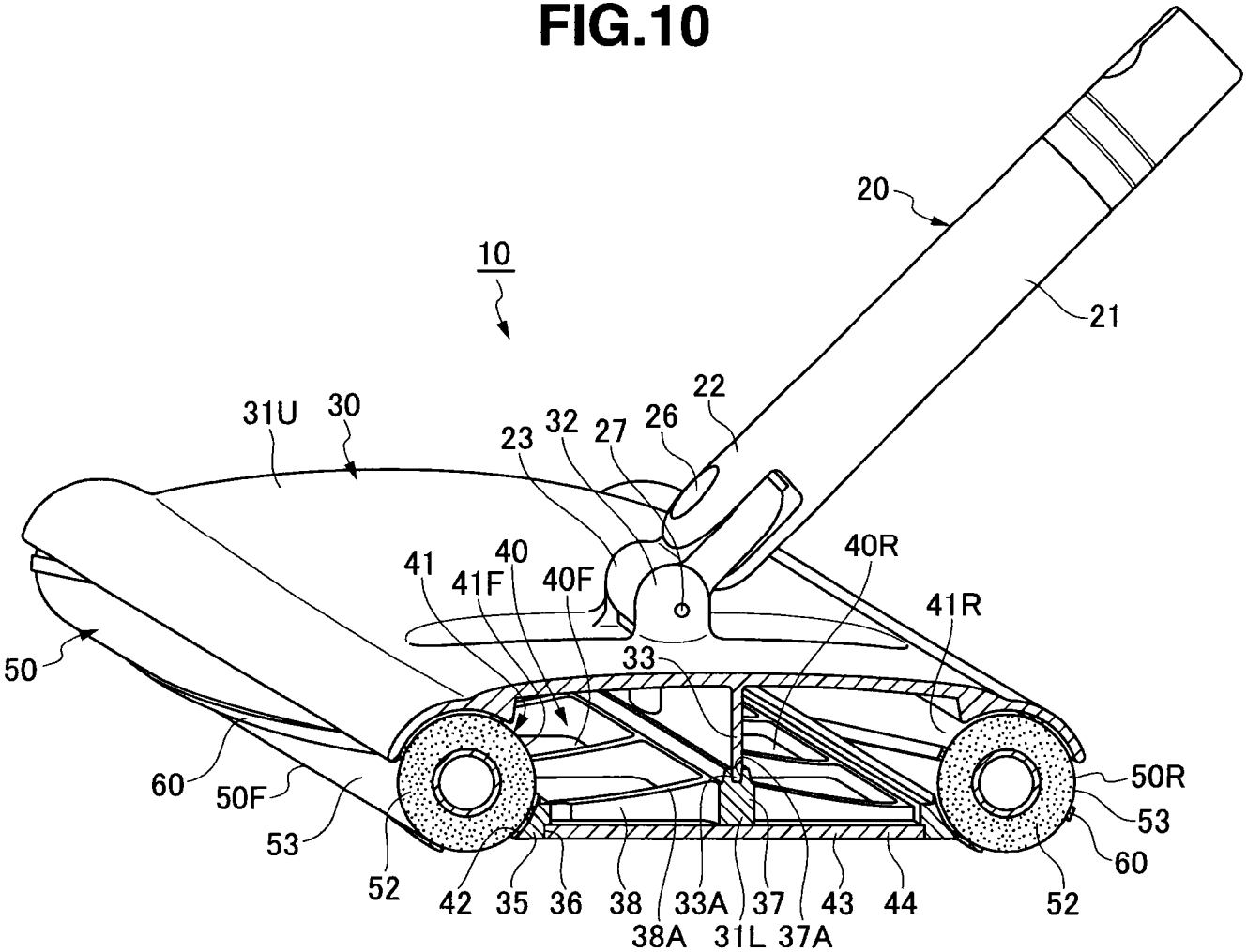
FIG. 10 is a perspective view illustrating another example of a cleaning tool.
Figure 11:
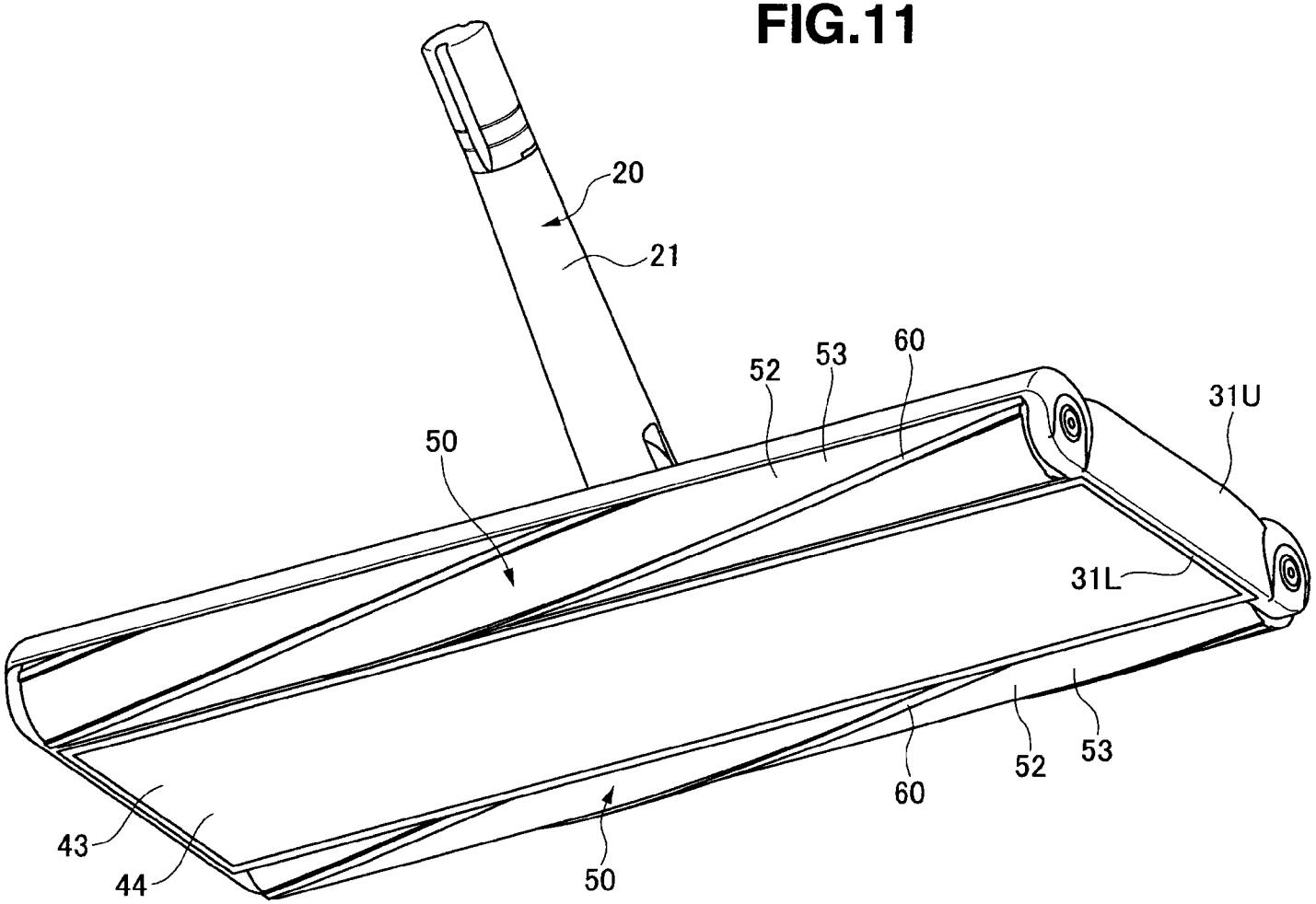
FIG. 11 is a perspective view illustrating a cleaning head from a lower surface side.
Figure 12:
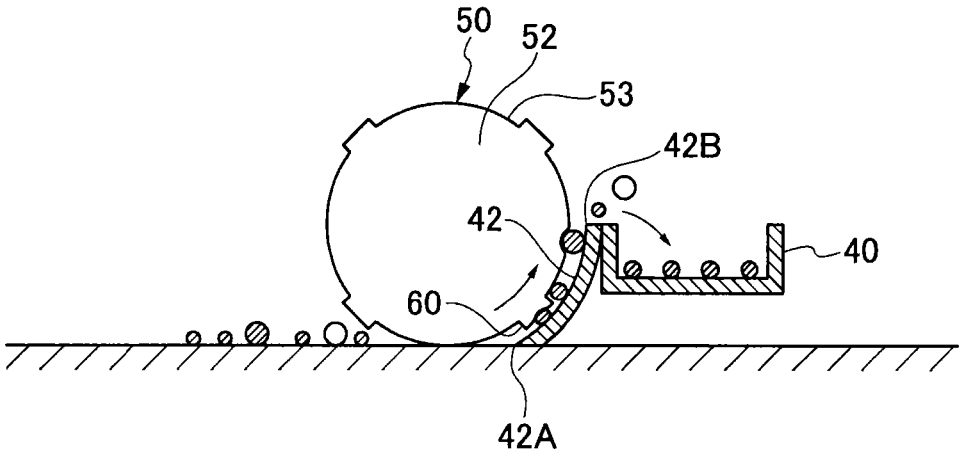
FIG. 12 is a schematic view illustrating a dust container, a dust guide surface and a cleaning roll.
Figure 13:
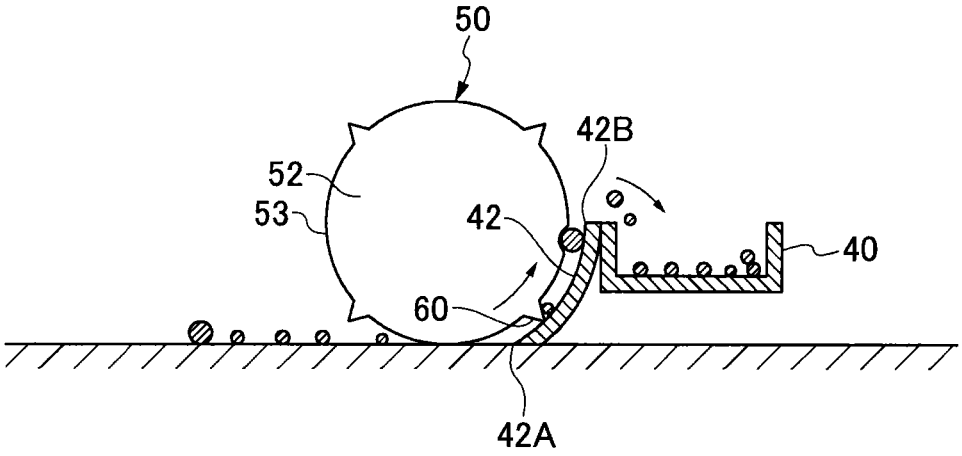
FIG. 13 is a schematic view illustrating the dust container, the dust guide surface and the cleaning roll.

The cleaning tool 10 illustrated in FIGS. 10 and 11 is a modification of the cleaning tool 10 illustrated in FIGS. 1 to 9 in which one or a plurality of strips 60 each having an elongated shape are spirally wound around the surface of the cleaning roll 50, and are appropriately fixed to the surface of the cleaning roll 50 with an adhesive or the like, and the thin film 53 covers the strips 60 and the surface of the cleaning roll 50. The strip 60 may have a rectangular or triangular cross section or the like as illustrated in FIGS. 12 and 13.

In the cleaning tool 10, preferably the cleaning roll 50 does not abut on the dust guide surface 42, and the strip 60 abuts on the dust guide surface 42. Namely, a minute gap is provided between the outer peripheries of the cleaning roll 50 and the dust guide surface 42 to allow smooth rotation of the cleaning roll 50, and the surface of the strip 60 is arranged in the position to be in contact with the outer periphery of the dust guide surface 42. Thereby, even the dust smaller in size than the foregoing minute gap can be collected by sandwiching the dust between the strip 60 and the dust guide surface 42, and the dust collecting efficiency can be improved. FIG. 12 illustrates a state in which the dust is sandwiched between an upper surface of the strip 60 having a rectangular cross section and the dust guide surface 42, and a front surface of the strip 60 scrapes up the dust. FIG. 13 illustrates a state in which the front surface of the strip 60 having a triangular cross section scrapes up the dust.

In the cleaning tool 10, the dust sandwiching mechanism between the strip 60 and the dust guide surface 42 is a mechanism primarily utilizing elastic deformation of the sponge roll 52. For example, when the strip 60 is merely arranged on a surface of a cylinder made of metal, the sandwiching mechanism between the strip 60 and the dust guide surface 42 is hardly formed although the strip 60 may sputter the dust.

In the cleaning tool 10, the strip 60 provided on the surface of the cleaning roll 50 has a spiral form. Therefore, in contrast to the strip 60 in a straight form, various portions in the longitudinal direction in the same strip 60 do not simultaneously abut on the dust guide surface 42 during rotation of the cleaning roll 50, but successively abut on the dust guide surface 42 to be in sliding contact with the dust guide surface 42. This can reduce a rotational resistance of the cleaning roll 50 due to such sliding contact, and can reduce the operation force so that the cleaning roll 50 on the surface to be cleaned also achieves a smooth and silent rolling property. Preferably, a winding angle and the number of windings of the strip 60 wound around the surface of the cleaning roll 50 are set such that the strip 60 on the cleaning roll 50 is always located on the surface to be cleaned in a plurality of locations in the axial direction of the cleaning roll 50 to achieve the smooth rolling property and the like of the cleaning roll 50.

It is to be noted that the present embodiment has been described in connection with the cleaning tool 10 in which the thin film 53 covers the strip 60 and the surface of the cleaning roll 50. Alternatively, the thin film 53 may cover the surface of the cleaning roll 50, and the strip 60 may be appropriately fixed over the thin film 53.

The strip 60 is preferably an elastic member, and materials used for the cleaning roll 50 to be described later may be used appropriately. When the strip 60 and the cleaning roll 50 are made of the same material, the strip 60 and the cleaning roll 50 may be formed integrally with each other by employing a processing method such as cutting processing and molding processing, instead of the method in which the strip 60 is fixed with an adhesive or the like to the outer peripheral surface of the cleaning roll 50.

It is to be noted that when the materials to be described later that are used for the strip 60 and the cleaning roll 50 are appropriately selected, the thin film 53 may not be required in some cases. For example, when the strip 60 and the cleaning roll 50 are made of a non-porous material of a low coefficient of friction, the thin film 53 may not be required in some cases.

The materials of the cleaning roll 50 and the thin film 53 will be described below.

Figure 14:
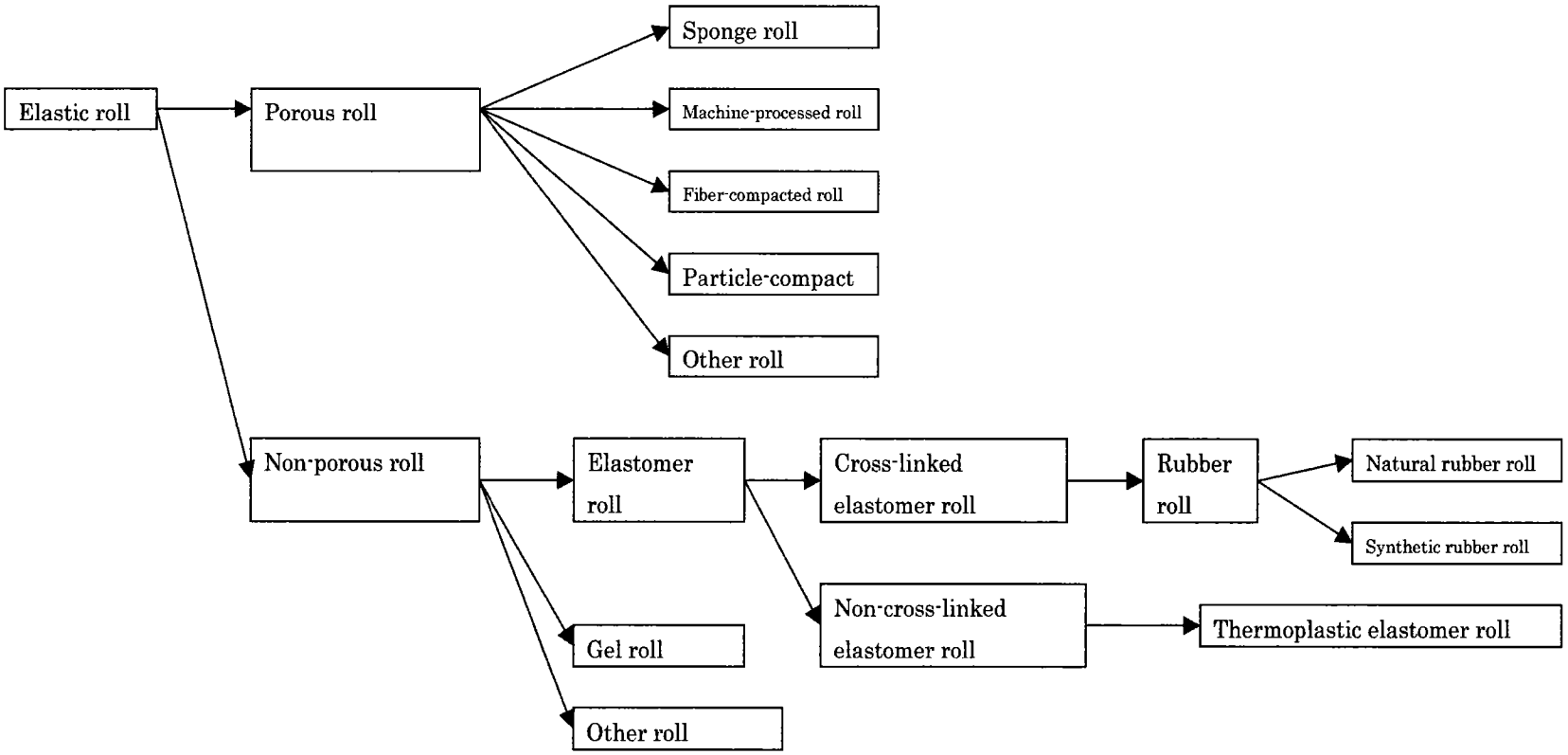
FIG. 14 is a diagram illustrating a specific example of materials of the cleaning roll.

(Specific Example of Materials Used for Cleaning Roll 50) (FIG. 14)

The cleaning roll 50 used in the present invention can appropriately use a material that can be used for the elastic roll. Specifically, as the material, a synthetic foamed resin prepared by foaming a known resin material such as urethane, polyethylene, polypropylene, melamine, thermoplastic elastomers and the like, and a natural sponge such as sponge may be used. As a machine-processed roll, for example, a non-foamed homogenous rubber roll having many spaces of regular or irregular shapes formed by a machine tool may be used. As a fiber-compacted roll, a roll formed of rounded thin nonwoven fabric or a roll obtained by processing a thick nonwoven fabric into a cylindrical form, or a roll formed of a flexible tube filled with wadding, or the like may be used. In addition, the flexible tube may also serve as a thin film (described in the claims). As a particle-compacted roll, a flexible tube filled with elastic particles of synthetic resin such as foamed styrene beads, or filled with elastic pipes cut into short lengths may be used. The flexible tube may also serve as a thin film (described in the claims). The size of the particle is preferably 3 mm or less, and further preferably 1 mm or less.

Examples of the material of the non-porous roll include natural rubber, synthetic rubber, elastomer materials such as thermoplastic elastomers, and gel. As the natural rubber roll, it is possible to use a material obtained by cross-linking sap obtained from rubber trees. As the synthetic rubber roll, it is possible to use acrylic rubber, nitrile rubber, isoprene rubber, urethane rubber, chloroprene rubber, silicone rubber, and butadiene rubber as well as synthetic rubber obtained by introducing a polyether structure, polyester structure or the like into a known polymeric material. As a thermoplastic elastomer roll, it is possible to use known thermoplastic elastomers such as urethane-, styrene- and olefin-based thermoplastic elastomers. As a gel roll, it is possible to use a silicone gel or the like.

The cleaning roll 50 may be made by compounding these materials, or compounding these and other materials. Examples of the manner of compounding include layering and mixing. In the case of mixing, melted materials may be mixed, or one of the materials may be fine-grained and dispersed in the other material. In addition, as other materials, a known polymeric material is suitable.

From a viewpoint of control stability of softness, workability, cost and others, the cleaning roll 50 is preferably a synthetic resin sponge and further preferably a urethane sponge.

(Specific Examples of Materials Used in Thin Film 53)

In the present invention, the specific examples of the material used in the thin film 53 include polyolefin resins such as polyethylene and polypropylene, polyester resins such as polyethylene terephthalate and polybutylene terephthalate, vinyl resins such as polyvinyl chloride, polyvinylidene chloride, an ethylene-vinyl acetate copolymer, and an ethylene-vinyl alcohol copolymer, cellulose resins such as cellophane and acetate, polyamide resins such as nylon, acrylic resins such as methyl polymethacrylate and polyacrylonitrile, fluororesin such as polytetrafluoroethylene, and urethane-, styrene-, and olefin-based thermoplastic elastomers. Also, the specific examples of the material include polyacetal, polycarbonate, polystyrene, polyarylate, polysulfone, polyether sulfone, polyether ether ketone, polyimide, polybutadiene, polyurethane, and silicone.

These polymeric materials may be blended and used as a polymer alloy. These may also be used as layered films. These may also be a resin that is cross-linked by a known method such as electron beams and ultraviolet.

Preferably, examples of the material include polyethylene, polypropylene, polyethylene terephthalate, polyvinyl chloride, polyvinylidene chloride, urethane- and styrene-based thermoplastic elastomers, and nylon. Further preferably, examples of the material include polyethylene, polypropylene, and urethane-based thermoplastic elastomers.

A material of which electrification is suppressed is preferable because the electrification of the film does not impair the dust collecting performance during use. Specifically, known methods may be used such as using a resin combined with a commercially available antistatic agent, and also using a resin with a carbon-based conductive filler such as acetylene black and carbon nanotube, or a metal-based conductive filler such as silver, copper and nickel kneaded therein, and using a film that has a layered metal foil of aluminum or the like, or has a metal deposition layer.

The cleaning roll 50 and the thin film 53 may be made of the same material (for example, when the cleaning roll 50 is a sponge roll made of urethane foam, the thin film 53 is a skin layer of the sponge.).

In connection with the above embodiment, the present invention further discloses the following cleaning tools.

<1> A cleaning tool having at least one side opening and a cleaning roll at a cleaning head, wherein a dust guide surface for leading dust from a surface to be cleaned to the side opening is provided along a lower end of the side opening;

the cleaning roll is formed of an elastic roller having a surface covered with a thin film, and is rotatably arranged in a position to close the side opening and to be in contact with the surface to be cleaned; and the cleaning roll rotating according to movement of the cleaning head takes the dust through the dust guide surface into the side opening while pushing the dust against the surface to be cleaned.

<2> The cleaning tool according to the above <1>, in which, preferably, a sheet-like wiper is provided on a lower surface of the cleaning head to be in contact with the surface to be cleaned.

<3> The cleaning tool according to the above <1> or <2>, in which, preferably, the cleaning head has a dust container comprising a side opening, and a sheet-like adhesive is provided on a bottom surface of the dust container.

<4> The cleaning tool according to the above <3>, in which, preferably, a cleaning sheet is removably provided on the lower surface of the cleaning head being contactable with the surface to be cleaned, and the cleaning tool comprises the sheet-like wiper on one surface of the cleaning sheet and the sheet-like adhesive on the other surface.

<5> The cleaning tool according to any one of the above <1> to <4>, in which, preferably, the cleaning head squashes under its own weight the cleaning roll on the surface to be cleaned to cause the lower surface of the cleaning head to abut on the surface to be cleaned.

<6> The cleaning tool according to any one of the above <1> to <5>, in which, preferably, the lower surface of the cleaning head and a lower end edge of the dust guide surface are set on the same horizontal surface.

<7> The cleaning tool according to any one of the above <1> to <6>, in which, preferably, a spiral elongated strip is provided on a surface of the cleaning roll, and the spiral elongated strip is provided on the surface of the cleaning roll with the strip covered with the thin film or the surface of the cleaning roll covered with the thin film.

<8> The cleaning tool according to the above <7>, in which, preferably, the cleaning roll does not abut on the dust guide surface, and the strip abuts on the dust guide surface.

<9> The cleaning tool according to any one of the above <1> to <8>, in which, preferably, the cleaning roll is formed of a plurality of roll members having different hardness.

<10> The cleaning tool according to any one of the above <1> to <9>, in which, preferably, the cleaning roll is formed of a sponge roll.

<11> The cleaning tool according to the above <10>, in which, preferably, the sponge roll is made of urethane form, and the thin film is made of thermoplastic polyurethane resin.

<12> The cleaning tool according to any one of the above <1> to <11>, in which, preferably, the cleaning head is formed of a combination of upper and lower frames coupled together, and the lower frame includes a plurality of cross members which are parallel to each other and each have a triangular cross section.

<13> The cleaning tool according to the above <12>, in which, preferably, the dust container is formed between the upper and lower frames.

<14> The cleaning tool according to the above <12> or <13>, in which, preferably, an outer side surface of the lower frame forms the dust guide surface.

<15> The cleaning tool according to the above <6>, in which, preferably, a lower end edge of the dust guide surface has an acute angle.

<16> The cleaning tool according to any one of the above <1> to <15>, in which, preferably, an upper end edge of the dust guide surface has an acute angle.

<17> The cleaning tool according to any one of the above <1> to <16>, in which, preferably, the cleaning roll has a hardness of 10 N to 100 N (measured by a measuring method of JIS K6400-2: 2004 (D method)).

<18> The cleaning tool according to any one of the above <1> to <16>, in which, preferably, the cleaning roll has a hardness of 15 N to 70 N (measured by a measuring method of JIS K6400-2: 2004 (D method)).

<19> The cleaning tool according to any one of the above <1> to <16>, in which, preferably, the cleaning roll has a hardness of 15 N to 60 N (measured by a measuring method of JIS K6400-2: 2004 (D method)).

<20> The cleaning tool according to any one of the above <1> to <16>, in which, preferably, the cleaning roll has a hardness of 15 N to 50 N (measured by a measuring method of JIS K6400-2: 2004 (D method)).

<21> The cleaning tool according to any one of the above <1> to <16>, in which, preferably, the cleaning roll has a hardness of 15 N to 40 N (measured by a measuring method of JIS K6400-2: 2004 (D method)).

<22> The cleaning tool according to any one of the above <1> to <21>, in which, preferably, the thin film has a film thickness of 10 μm to 100 μm.

<23> The cleaning tool according to any one of the above <1> to <21>, in which, preferably, the thin film has a film thickness of 10 μm to 50 μm.

<24> The cleaning tool according to any one of the above <1> to <21>, in which, preferably, the thin film has a film thickness of 10 μm to 40 μm.

<25> The cleaning tool according to any one of the above <1> to <21>, in which, preferably, the thin film has a film thickness of 20 μm to 40 μm.

<26> The cleaning tool according to any one of the above <1> to <25>, in which, preferably, the cleaning roll rotates rolling by itself on the surface to be cleaned by an operation force of a user, and is not accompanied with drive wheels at its opposite end sides.

<27> A cleaning tool having at least one side opening and a cleaning roll at a cleaning head, in which a dust guide surface for leading dust from a surface to be cleaned to the side opening is provided along a lower end of the side opening;

the cleaning roll is formed of an elastic roll, and is rotatably arranged in a position to close the side opening and to be in contact with the surface to be cleaned;

the cleaning roll is formed of a plurality of roll members having different hardness; and the cleaning roll rotating according to movement of the cleaning head takes the dust through the dust guide surface into the side opening while pushing the dust against the surface to be cleaned.

<28> The cleaning tool according to above <27>, in which, preferably, hard roll members harder than the main roll member are provided at the opposite end sides of the cleaning roll.

<29> A cleaning tool having at least one side opening and a cleaning roll at a cleaning head, in which a dust guide surface for leading dust from a surface to be cleaned to the side opening is provided along a lower end of the side opening;

the cleaning roll is formed of an elastic roll, and is rotatably arranged in a position to close the side opening and to be in contact with the surface to be cleaned;

a spiral elongated strip is provided on a surface of the cleaning roll; and the cleaning roll rotating according to movement of the cleaning head takes the dust through the dust guide surface into the side opening while pushing the dust against the surface to be cleaned.

<30> The cleaning tool according to above <29>, in which, preferably, the cleaning roll dose not abut on the dust guide surface, and the strip abuts on the dust guide surface.

INDUSTRIAL APPLICABILITY

According to the present invention, since the cleaning roll 50 having the elastic roll covered with the thin film 53 is used, the dust on the surface to be cleaned can be stably collected through a wide range of the surface to be cleaned.

EXPLANATIONS OF LETTERS OF NUMERALS

10 Cleaning tool
30 Cleaning head
40 Dust container
41 Side opening
42 Dust guide surface
42A Lower end edge
42B Upper end edge
44 Cleaning sheet
44B Sheet-like wiper
44C Sheet-like adhesive
50 Cleaning roll (Pushing roll)
52 Sponge roll
53 Thin film
60 Strip

What is claimed is:

1. A cleaning tool comprising:

at least one side opening; and a cleaning roll at a cleaning head, wherein a dust guide surface to lead dust from a surface to be cleaned to the at least one side opening is provided along a lower end of the at least one side opening, the cleaning roll is formed of an elastic roller having a surface covered with a thin film, and is rotatably arranged in a position to close the at least one side opening and to be in contact with the surface to be cleaned, and rotation of the cleaning roll according to movement of the cleaning head takes the dust through the dust guide surface into the at least one side opening while pushing the dust against the surface to be cleaned.

2. The cleaning tool according to claim 1, wherein a wiper in the form of a sheet is provided on a lower surface of the cleaning head to be in contact with the surface to be cleaned.

3. The cleaning tool according to claim 2, wherein the cleaning head has a dust container comprising the at least one side opening, and an adhesive in the form of a sheet is provided on a bottom surface of the dust container.

4. The cleaning tool according to claim 2, wherein the cleaning head squashes, under its own weight, the cleaning roll on the surface to be cleaned, to cause the lower surface of the cleaning head to abut on the surface to be cleaned.

5. The cleaning tool according to claim 2, wherein the lower surface of the cleaning head and a lower end edge of the dust guide surface are set on a same horizontal surface.

6. The cleaning tool according to claim 2, wherein a spiral elongated strip is provided on a surface of the cleaning roll, and the spiral elongated strip is provided on the surface of the cleaning roll, with the spiral elongated strip covered with the thin film or the surface of the cleaning roll covered with the thin film.

7. The cleaning tool according to claim 2, wherein the cleaning roll is formed of a plurality of roll members having different hardness.

8. The cleaning tool according to claim 2, wherein the cleaning roll is formed of a sponge roll.

9. The cleaning tool according to claim 1, wherein the cleaning head has a dust container comprising the at least one side opening, and an adhesive in the form of a sheet is provided on a bottom surface of the dust container.

10. The cleaning tool according to claim 1, wherein a cleaning sheet is removably provided on a lower surface of the cleaning head contactable with the surface to be cleaned, and the cleaning tool further comprises a wiper in the form of a sheet on a first surface of the cleaning sheet and the adhesive in the form of a sheet on a second surface of the cleaning sheet.

11. The cleaning tool according to claim 1, wherein the cleaning head squashes, under its own weight, the cleaning roll on the surface to be cleaned, to cause a lower surface of the cleaning head to abut on the surface to be cleaned.

12. The cleaning tool according to claim 1, wherein a lower surface of the cleaning head and a lower end edge of the dust guide surface are set on a same horizontal surface.

13. The cleaning tool according to claim 1, wherein a spiral elongated strip is provided on a surface of the cleaning roll, and the spiral elongated strip is provided on the surface of the cleaning roll, with the spiral elongated strip covered with the thin film or the surface of the cleaning roll covered with the thin film.

14. The cleaning tool according to claim 13, wherein the cleaning roll does not abut on the dust guide surface, and the spiral elongated strip abuts on the dust guide surface.

15. The cleaning tool according to claim 1, wherein the cleaning roll is formed of a plurality of roll members having different hardness.

16. The cleaning tool according to claim 1, wherein the cleaning roll is formed of a sponge roll.

17. The cleaning tool according to claim 16, wherein the sponge roll is made of urethane form, and the thin film is made of thermoplastic polyurethane resin.

18. The cleaning tool according to claim 1, wherein the cleaning roll, the elastic roller, and the thin film are cylindrical.

* * * * *